US010137060B2

(12) United States Patent
Mizani

(10) Patent No.: US 10,137,060 B2
(45) Date of Patent: Nov. 27, 2018

(54) INFANT PACIFIER WITH IMPROVED RETENTION

(71) Applicant: Pedram Mizani, Irvine, CA (US)

(72) Inventor: Pedram Mizani, Irvine, CA (US)

( * ) Notice: Subject to any disclaimer, the term of this patent is extended or adjusted under 35 U.S.C. 154(b) by 0 days.

(21) Appl. No.: 14/792,606

(22) Filed: Jul. 6, 2015

(65) Prior Publication Data

US 2016/0000659 A1 Jan. 7, 2016

Related U.S. Application Data

(60) Provisional application No. 62/020,571, filed on Jul. 3, 2014.

(51) Int. Cl.
*A61J 17/00* (2006.01)

(52) U.S. Cl.
CPC ..... *A61J 17/001* (2015.05)

(58) Field of Classification Search
CPC ..... A61J 17/00; A61J 17/001; A61J 17/002; A61J 17/003; A61J 17/005; A61J 17/006; A61J 17/007; A61J 17/008
See application file for complete search history.

(56) References Cited

U.S. PATENT DOCUMENTS 4,700,408 A 10/1987 Winger
4,898,171 A 2/1990 Moss
5,146,913 A 9/1992 Khorsandian et al.
5,459,903 A 10/1995 Treacy
5,948,003 A * 9/1999 Shefflin ..... A61J 17/008 606/234
6,068,649 A 5/2000 Chamberlain
6,923,332 B1 8/2005 Thomas
8,011,069 B1 9/2011 Klein
2010/0152774 A1* 6/2010 Branham ..... A61J 17/008 606/236
2013/0317547 A1 11/2013 Rohrig
2013/0319965 A1 12/2013 Reynolds

* cited by examiner

*Primary Examiner* — Anh T Dang

(74) *Attorney, Agent, or Firm* — Klein, O'Neill & Singh, LLP

(57) ABSTRACT

An improved infant pacifier includes a nipple configured to trigger an infant's sucking reflex so as to provide a tool for nourishment and also a calming effect for an infant. An extension depends from a distal end of the nipple to a retainer portion that extends proximally from the extension and is spaced from the nipple. The retainer portion terminates in a proximal contact pad. When the nipple is in the child's mouth, the contact pad engages the child's skin under the chin. Preferably a biasing force gently urges the contact pad toward the nipple, maintaining engagement with the child's skin, and helping retain the nipple in the child's mouth even without any effort on the child's part to retain the nipple. Various specific structures of pacifiers employing these principles are provided.

20 Claims, 12 Drawing Sheets

INFANT PACIFIER WITH IMPROVED RETENTION

CROSS-REFERENCE TO RELATED APPLICATIONS

The application claim the benefit of U.S. Provisional Application No. 62/020,571, which was filed on Jul. 3, 2014, the entirety of which is hereby incorporated by reference.

BACKGROUND

The present disclosure relates to the field of infant pacifiers.

Infant pacifiers are often used to soothe babies. Infants often find comfort sucking on the nipple portion of a pacifier. However, although they often succeed at soothing infants, pacifiers may easily pop out of the infant's mouth. This is sometimes due to the infant affirmatively spitting out the pacifier, but is often due to the infant not having sufficient control or understanding to either retain the pacifier or avoid pushing it out of her mouth.

As such, parents will often apply gentle pressure or support to the pacifier so that it remains engaged in the child's mouth. Alas, once such parental pressure is removed, the pacifier often falls yet again from the child's mouth.

Because of the relatively high maintenance required to keep a pacifier engaged in their child's mouth, many parents abandon use of pacifiers, even though the pacifier does in fact provide soothing comfort to their child.

SUMMARY

Accordingly, there is a need in the art for a pacifier, or product to be used with a pacifier, that will safely help to maintain the pacifier in a child's mouth.

In accordance with one embodiment, the present disclosure provides a pacifier comprising a nipple portion and a retainer portion. The nipple portion comprises a bulb that extends proximally from a stem. The retainer portion is spaced from the nipple portion and extends proximally, terminating at a contact pad. An extension extends between the nipple portion and the retainer portion, and at least part of the extension is distal of the nipple portion. The retainer portion is biased toward the nipple portion.

In some such embodiments the contact pad comprises a grip surface.

In accordance with another embodiment, the present disclosure provides a pacifier retainer configured to attach to a pacifier having a nipple portion with a bulb and a stem. The pacifier retainer comprises an elongate extension having a connector at or adjacent a first end, the connector being configured to attach to the pacifier so that the nipple portion extends proximally from the connector. A retainer portion is attached to the extension at a location spaced from the connector, the retainer portion extending proximally from the extension. The extension and retainer portion are configured so that the retainer portion is spaced from the pacifier nipple portion when the extension connector is attached to the pacifier. The retainer portion is biased toward the nipple portion.

In accordance with yet another embodiment, the present disclosure provides a method of soothing an infant. The method comprises inserting a nipple portion into the infant's mouth so that a stem extends out of the infant's mouth, and engaging a retainer portion with a portion of the infant's face spaced from the mouth so that a contact pad of the retainer portion applies a biasing force against the infant's face. The retainer portion is attached to the stem via an extension. The biasing force is directed generally toward the nipple portion, and helps retain the nipple portion in the infant's mouth.

In some such embodiments, the contact pad of the retainer portion is applied under the infant's chin.

Further embodiments additionally comprise plastically adjusting a shape of the extension prior to applying the grip under the infant's chin.

DESCRIPTION

Figure 1:
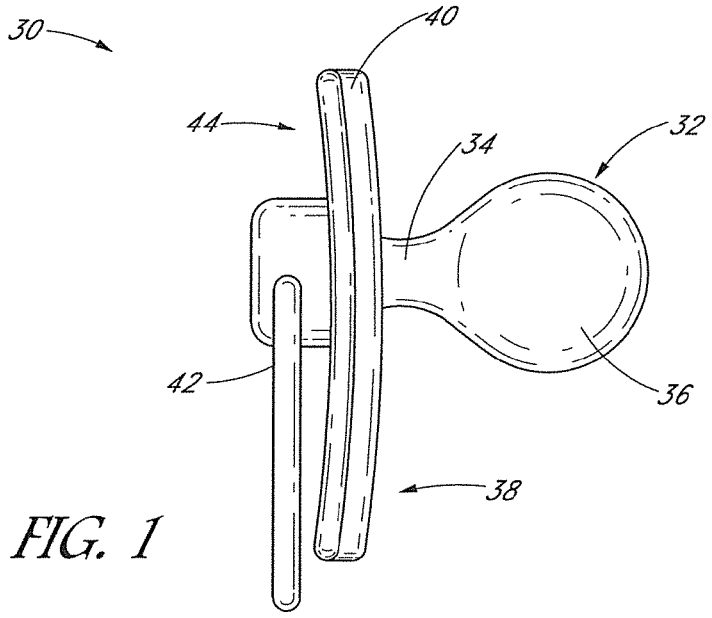
FIG. 1 is a side view of a conventional pacifier.
Figure 2:
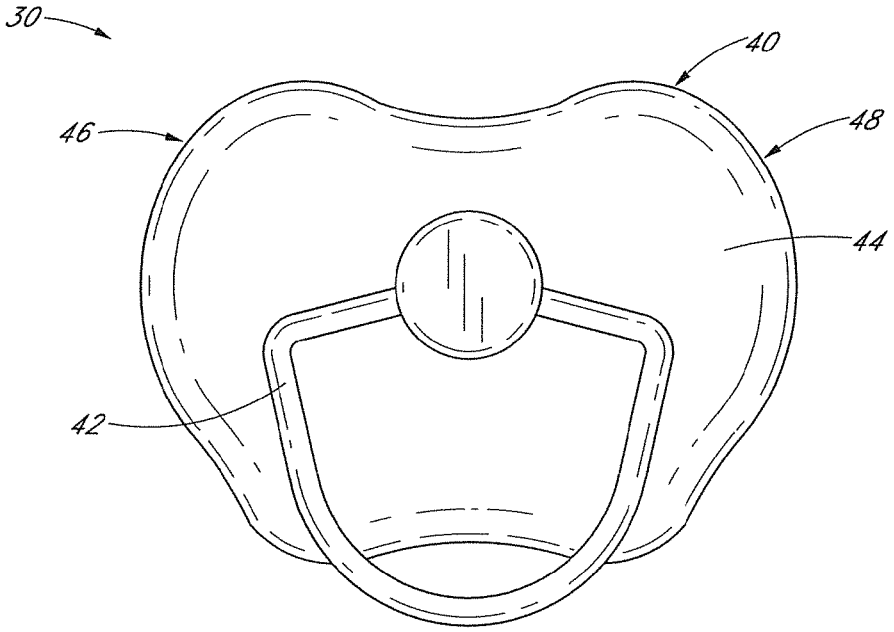
FIG. 2 is a back view of the pacifier of FIG. 1.
Figure 3:
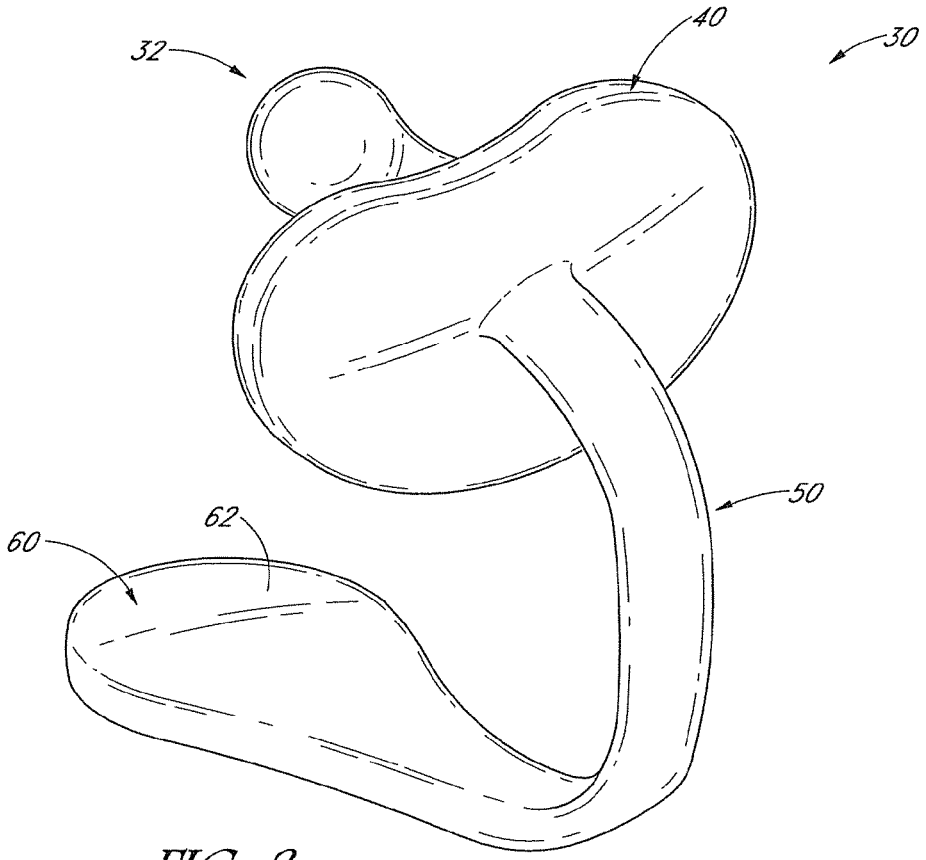
FIG. 3 is a perspective view of an embodiment of a pacifier having features in accordance with the present disclosure.

With initial reference to FIGS. 1 and 2, a typical, conventional pacifier 30 is shown. The illustrated pacifier 30 depicts features and components that are shared by most pacifiers, including a nipple portion 32 comprising a stem 34 leading to a soft bulb 36. The stem 34 extends in a proximal direction from a front or face side 38 or surface of a shield 40 or face plate. A handle 42 is often formed on or attached to a back side 44 or surface of the shield 40 opposite the nipple portion 32. The shield 40 is preferably wide enough to cover all or most of the infant's face surrounding her mouth, and can comprise first and second wings 46, 48. In use, an infant sucks on the nipple portion, and the front side 38 of the shield 40 engages the infant's face. Of course, it is known and contemplated to provide many different types of pacifiers in which each of the pacifier components can come in various shapes, sizes and styles.

This description presents and discusses several embodiments, which together present various structural features. The different structural features of the components discussed in these embodiments are examples of embodiments of the individual components. It is to be understood that components having features as discussed in different embodiments can be selectively combined. Thus, it is contemplated that embodiments that are not specifically discussed herein can be made by combining features of components of the embodiments that are specifically described.

With reference next to FIGS. 3-7, one embodiment of an improved pacifier 30 is depicted. As shown, the pacifier 30 includes a nipple portion comprising a bulb 36 and a stem 34 that extends proximally from a shield 40, such as a generally oval-shaped shield 40. An extension 50 extends outwardly and distally from the back side of the shield 40 opposite the stem 34 and, in the illustrated embodiment, curves downwardly relative to an axis 52 of the stem 34/nipple 32 and transitions into a retainer portion 55. The retainer portion 55 extends proximally, generally parallel to and spaced from the axis 52 of the stem 34. In the illustrated embodiment, the retainer portion 55 includes a contact pad 60 or grip. As shown, the nipple portion 32 and contact pad 60 are spaced from one another and connected via the extension 50. Preferably, the proximal end of the contact pad 60 is aligned with or spaced proximal of the proximal end of the nipple 32.

Figure 5:
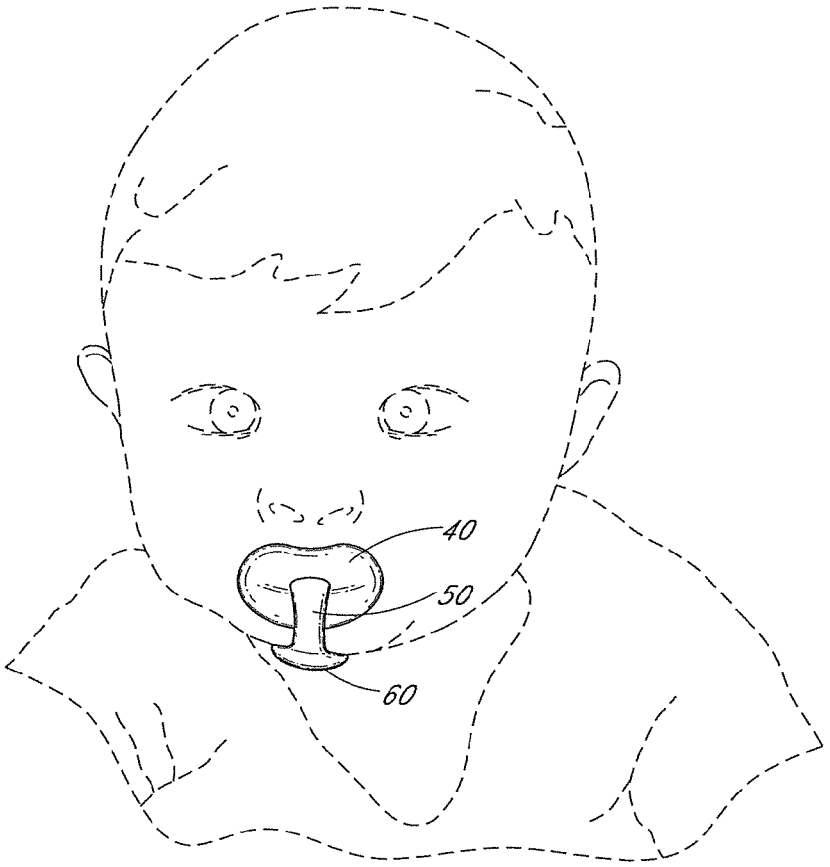
FIG. 5 shows the embodiment of FIG. 3 being used by an infant.
Figure 6:
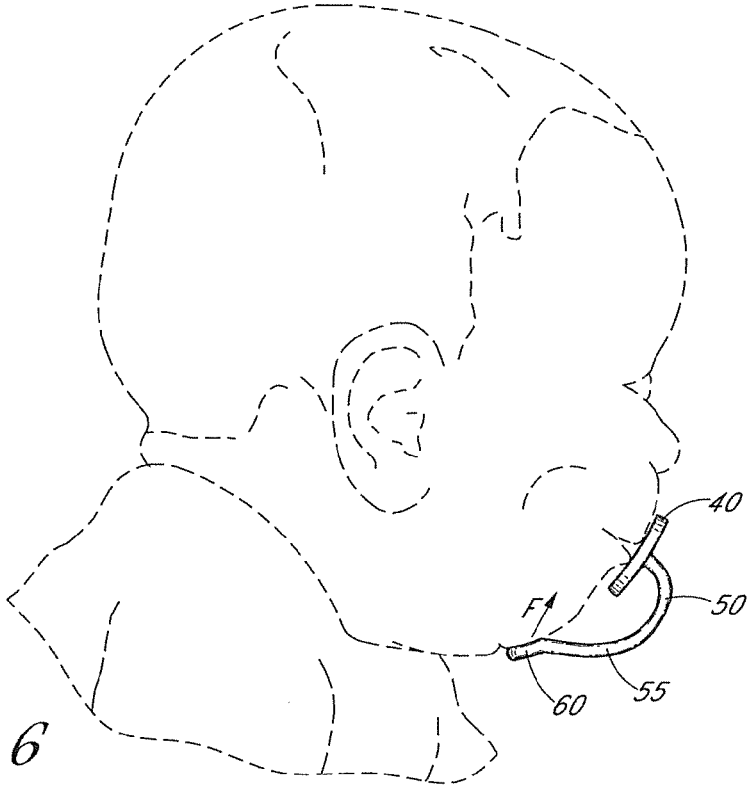
FIG. 6 is a side view of the arrangement in FIG. 5.

In use, and as best shown in FIGS. 5 and 6, the nipple portion 32 of the pacifier 30 extends into the infant's mouth, while the retainer portion 55 extends under the chin, and a grip surface 62 of the pad engages the infant's skin under the chin. Preferably, the contact pad 60 is biased gently toward the nipple portion so that a gentle biasing force F squeezes between the child's mouth and chin, or more specifically between the grip and the nipple 32. Also, preferably the pad has a substantially greater width than does the extension 50 so that biasing forces F can be distributed across the grip surface 62. In the illustrated embodiment, the pad is generally circular or oval in shape.

The biasing force F helps to retain the pacifier 30 in the child's mouth during periods in which the child may stop sucking and/or may open his mouth. In some embodiments the biasing force will be quite small so that the child may still intentionally eject the pacifier 30 from his mouth; however, preferably the biasing force is great enough to prevent the pacifier 30 from dropping from the infant's mouth when, for example, the infant temporarily forgets to apply suck and/or temporarily opens her mouth, or as a result of natural reflexes.

Figure 4:
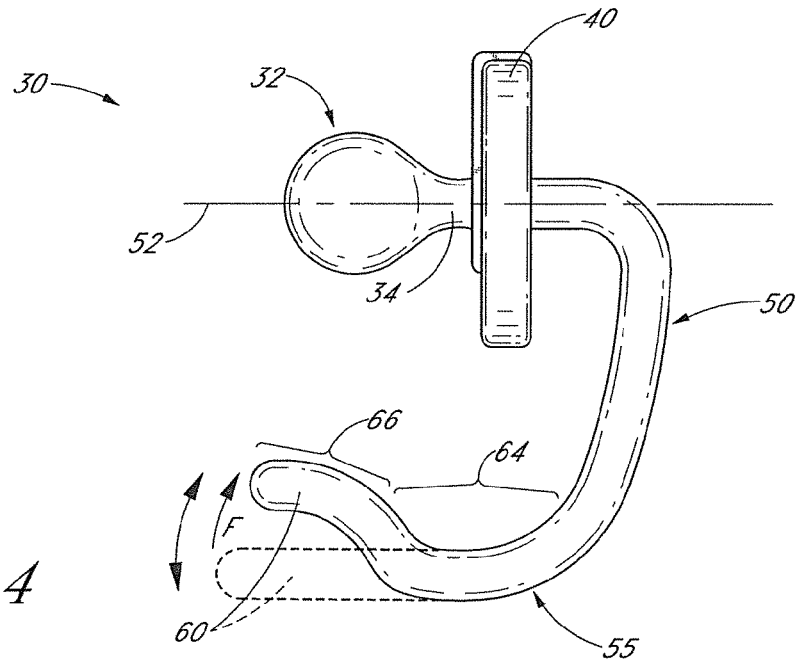
FIG. 4 is a side view of the embodiment of FIG. 3.

In the illustrated embodiment, the retainer portion 55 is biased toward the nipple portion 32. Specifically, FIG. 4 illustrates that, when at rest, the retainer portion 55 extends toward the nipple portion. When fit onto a child's chin, however, the retainer portion 55 can be deflected to a flexed position in order to fit about the child's chin and also in order to generate the biasing force F.

In the illustrated embodiment, a first deflection zone 64 is defined in part of the extension 50 and part of the retainer portion 55. The pacifier 30 has structure defining first deflection characteristics in the first deflection zone 64. A second deflection zone 66 is defined within the retainer portion 55, at and adjacent the pad. Second deflection characteristics are defined in the second deflection zone 66. This enables biasing behavior to be designed into the pacifier 30 as desired. For example, the first deflection zone 64 may be relatively rigid, and the second deflection zone 66 may be more compliant than the first deflection zone 64 in order to maximize comfort for the infant. It is to be understood that other embodiments may employ more or less deflection zones, which may overlap, and can customize the deflection characteristics within each zone. Also, in some embodiments, the entire pacifier 30, including the nipple 32, extension 50 and retainer portions 55, may be biased inwardly. In other embodiments, only selected portions such as the extension and retainer portions are biased inwardly.

Figure 7:
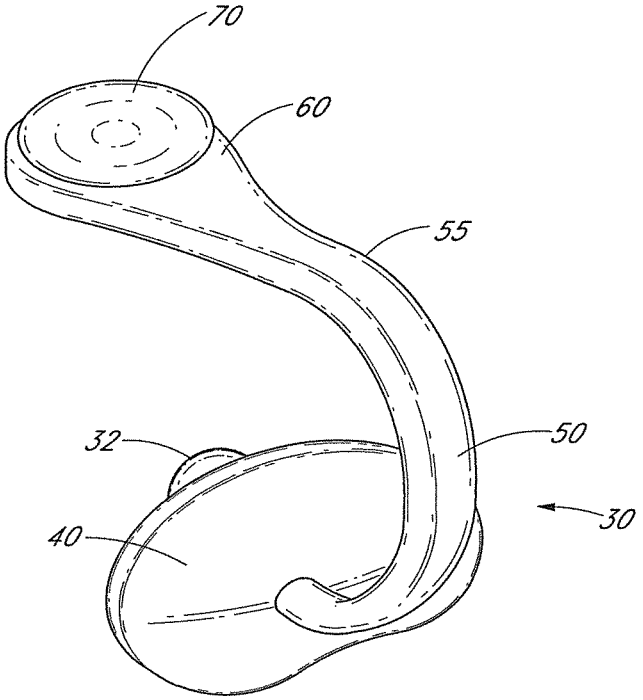
FIG. 7 is a bottom perspective view of the embodiment of FIG. 3.

With reference next to FIG. 7, in the illustrated embodiment, a suction cup 70 is formed on a bottom surface of the contact pad 60 opposite the grip surface 62. The suction cup 70 can be employed to retain the pacifier 30 on a flat surface such as a table, kitchen wall, or high chair so as to retain the pacifier in place, enabling drying of the pacifier after it is washed and/or preventing the pacifier from moving around or becoming lost.

Pacifiers in accordance with the present disclosure can be made of many types of flexible and gentle materials, such as silicone, rubber, polymers, and the like. In some embodiments, the entire pacifier is constructed of such materials. In other embodiments, combinations of materials may be employed. For example, the nipple portion may be an elastomer such as rubber, but the stem 34 may be a hard plastic, and the retainer portion may be a soft plastic and/or a hard plastic or metal with a soft elastomeric coating such as silicone. Thus, various combinations of materials are anticipated as desired.

Figure 8:
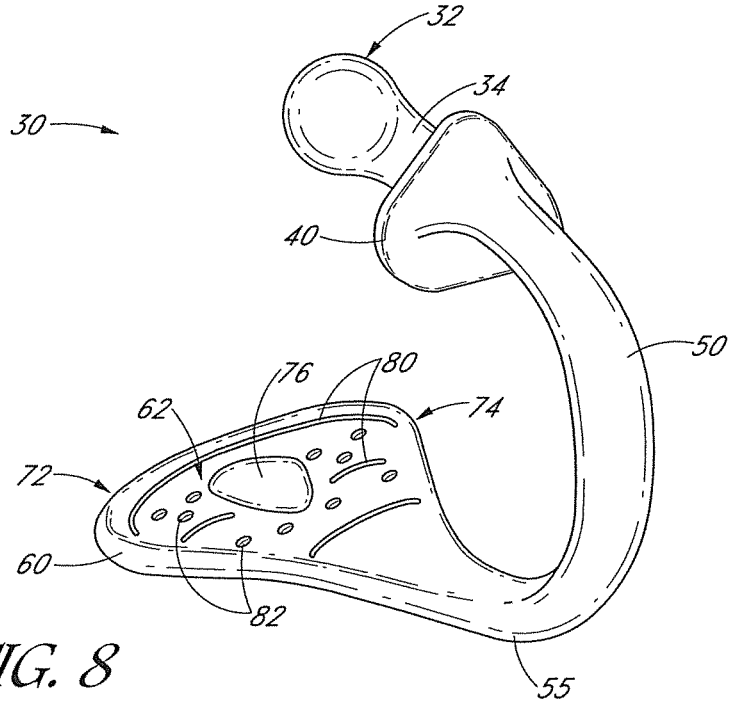
FIG. 8 is a perspective view of another embodiment having features in accordance with the present disclosure.

With reference next to FIG. 8, another embodiment of a pacifier 30 is illustrated having a relatively small, triangular-shaped shield 40. The contact pad 60 is also generally triangular-shaped, having opposing first and second wings 72, 74. An insert 76 can be disposed generally centrally in the contact pad 60. In one embodiment, the insert 76 can be formed of a tacky elastomeric material configured to avoid slipping over the infant's skin. In another embodiment, the insert 76 can comprise a foam, cloth or other absorbent material configured to absorb fluids such as saliva that may drain from the infant's mouth.

With continued reference to FIG. 8, the grip surface 62 of the contact pad 60 can be treated and/or may incorporate structure that is configured to increase friction with the child's skin. For example, in the illustrated embodiment, the grip surface 62 comprises a textured surface having a plurality of raised ridges 80 that extend across the contact pad 60 in a direction transverse to the nipple stem axis raised bumps 82 and/or soft spikes can also be provided as shown. Some embodiments may employ both raised ridges 80 and bumps 82, or one or the other, or other shapes as desired. In some embodiments the grip surface 62 texture can be configured to apply a massaging, or otherwise soothing feel, to the child's chin. In still other embodiments the grip surface 62 may include a mild adhesive, preferably a waterproof and child-safe adhesive.

Figure 9:
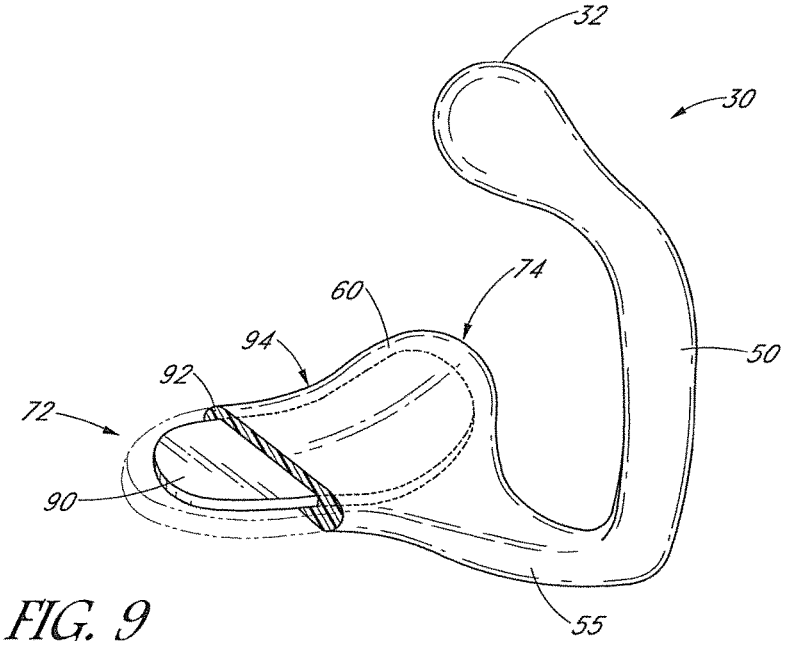
FIG. 9 is a perspective view of yet another embodiment.

With reference next to FIG. 9, yet another embodiment is shown. In this embodiment there is no shield at or adjacent the nipple 32. However, it is to be appreciated that the contact pad and act as a shield, helping to prevent a choking hazard. Further, this embodiment shows a structure in which a biasing insert 90, such as a metallic or plastic insert, is encased in elastomeric material 92 in the contact pad 60. The biasing insert 90 can provide the biasing force F to help engage the infant's chin. Also, in embodiments in which the contact pad 60 has opposing first and second wings 72, 74, the biasing insert 90 can be configured so that the first and second wings 72, 74 are biased upwardly toward the nipple 32 relative to (or about) a center portion 94 between the wings 72, 74 so as to form a generally concave shape. As such, not only is the contact pad 60 biased toward the nipple 32 to help hold the pacifier 30 in place, but the opposed biasing wings of the contact pad 60 also operate to at least partially self-center the pacifier 30. In some embodiments, the contact pad can be sized so that the wings reach at least partially to the child's cheeks.

Figure 10:
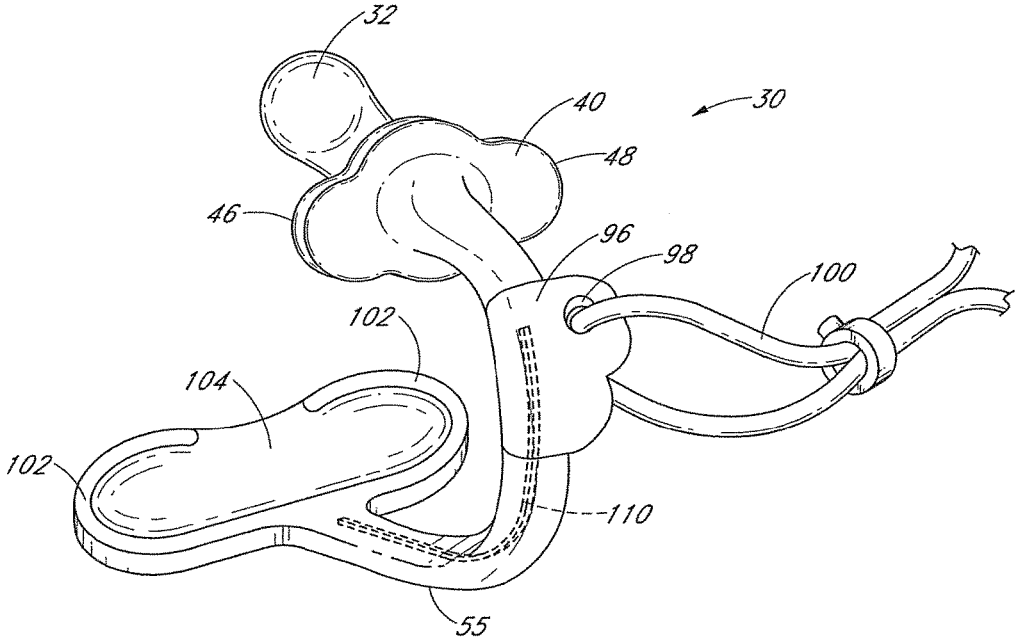
FIG. 10 is a perspective view of still another embodiment.

With reference next to FIG. 10, still another embodiment of a pacifier 30 is illustrated. This pacifier 30 employs a shield 40 having yet another shape. In this embodiment, opposing wings 46, 48 of the shield 40 each have a height that is less than the height at a center of the shield 40 between the wings. Also, as shown, the extension 50 can accommodate a clip 96 having an aperture 98 configured to accept a string or lanyard 100, which lanyard 100 can be attached to the infant's clothing or otherwise used to keep hold of the pacifier 30.

The embodiment in FIG. 10 depicts yet another embodiment of a contact pad 60 in which a portion of the contact pad 60 is at least partially encircled by a relatively-rigid frame 102. An insert portion 104 of the contact pad 60 is disposed within the frame 102 and comprises a relatively soft and sticky elastomeric material. Of course, the contact pad 60 may, instead of or in addition to the elastomeric material, employ a biasing insert enclosed within the contact pad 60.

The embodiment illustrated in FIG. 10 also depicts a malleable insert 110, such as a metal ribbon, encased within the extension 50 and part of the retainer portion 55. A user can purposefully bend the extension 50 to alter the shape of the pacifier 30, which bending will plastically deform the malleable insert 110. For example, the malleable insert 110 can be bent to so as to vary the length or arcuate shape of the extension 50 to better fit the mouth-to-chin distance and shape of a particular child's face. Because the deformation during such bending is plastic deformation, the extension 50 will generally retain its bent shape. In some embodiments, the malleable insert may have little or nothing to do with biasing. In other embodiments, however, the malleable insert 110, after being plastically deformed to the desired shape, retains a range of elastic bending and provides at least some biasing.

It is anticipated that the biasing force, including one or more different deflection zones, may be provided in any of several ways and structures. For example, in some embodiments the pacifier 30 may be injection-molded so that the contact pad's at-rest position is biased toward the nipple portion. In other embodiments, an insert, such as a plastic or metal ribbon, can be encased within the contact pad 60, retainer portion 55, extension 50, and/or other components of the pacifier 30 so as to supply the biasing force F when the retainer portion 55 is deflected. And as discussed above, multiple deflection zones, each having different deflection characteristics, can be employed. In some embodiments, a pacifier can include both one or more malleable insert and/or one or more biasing insert. The malleable insert 110 would enable a caregiver to customize the size and shape of the pacifier (including the effective length and shape of the extension 50 and/or the retainer portion 55); the biasing insert would enable application of a suitable biasing force.

In still other embodiments, rather than applying a substantial biasing force in which the retainer portion 55 is biased toward the nipple portion, the pacifier can rely upon increased friction by the grip surface or other pacifier surfaces to retain the nipple portion in the child's mouth. For example, the structures and textures described above can provide such friction, and in particular an adhesive applied to the grip surface and/or other pacifier surfaces can be effective.

It is to be understood that the principles discussed herein in connection with specific embodiments can also be applied to different specific structures. For example, in yet another embodiment, a pacifier can be configured so that the extension extends over one (or both) cheeks, and the retainer portion can extend around and even behind the child's neck or head. Preferably a biasing force and/or increased-friction surface helps hold the pacifier in place.

Additionally, various specific shapes can be contemplated. For example, in one embodiment the nipple portion, extension and retainer portion can be shaped to resemble a human thumb and forefinger arranged generally in a "U" shape.

Figure 11:
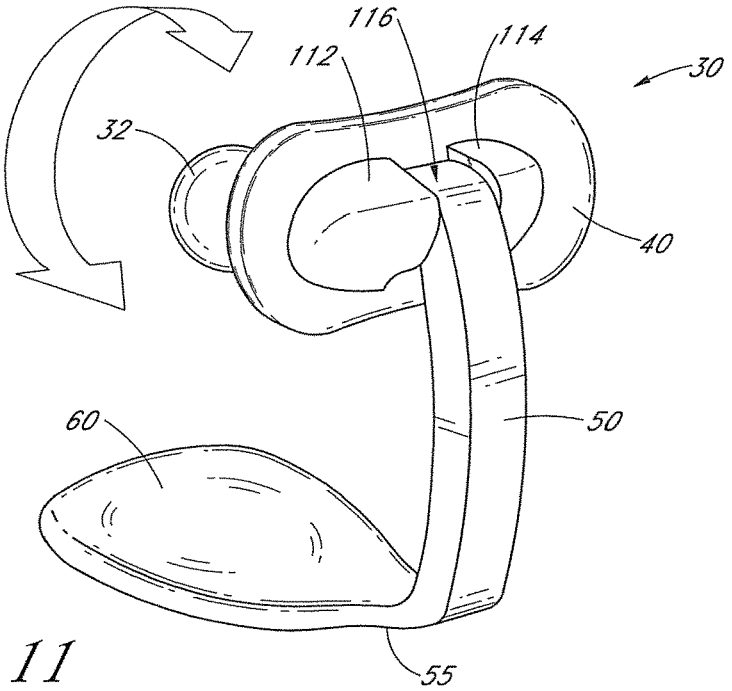
FIG. 11 is a perspective view of a yet further embodiment in a first configuration.
Figure 12:
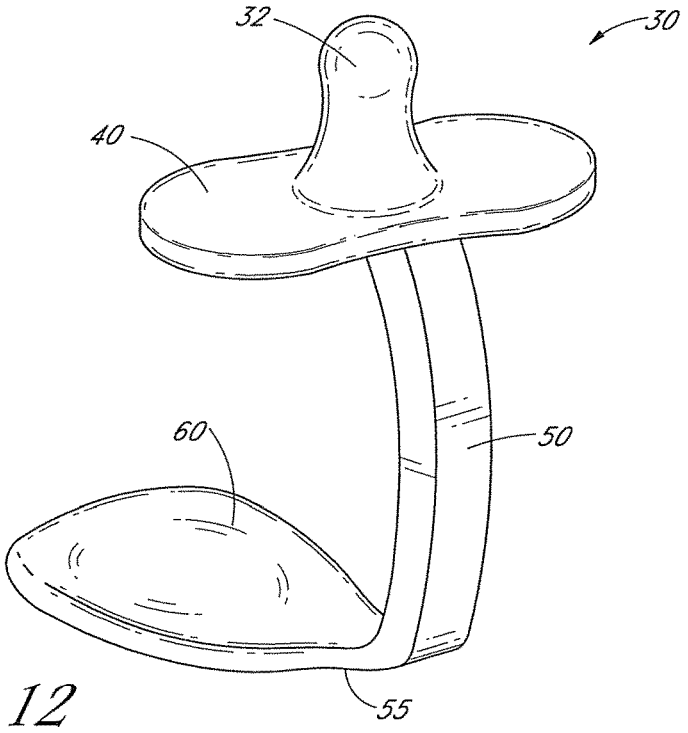
FIG. 12 shows the embodiment of FIG. 11 in a second configuration.

With reference next to FIGS. 11 and 12, another embodiment is disclosed in which the shield 40, including the nipple 32, is rotatable relative to the extension 50. More specifically, in the illustrated embodiment, the nipple 32 is rigidly attached to the shield 40, and a back surface of the shield 40 includes opposing first and second receivers 112, 114. The extension 50 is formed separately from the shield 40, and a first end 116 of the extension 50 is positioned between the first and second receivers 112, 114 of the shield 40. Preferably the first end 116 of the extension 50 includes posts (not shown) on opposing sides, which posts are received into the first and second receivers 112, 114 in a manner so that the extension posts are rotatable within the receivers. In some embodiments, one or more detents can be provided to releasably hold the shield 40 and nipple 32 at a first configuration as shown in FIG. 11 or a second configuration as shown in FIG. 12. In the first configuration, the pacifier 30 is configured so that the contact pad 60 engages below the child's chin when the nipple 32 is in the child's mouth. In the second configuration, the contact pad 60 is free of the child's chin when the nipple 32 is in the child's mouth, and the pacifier 30 can function as a typical conventional pacifier.

Figure 13:
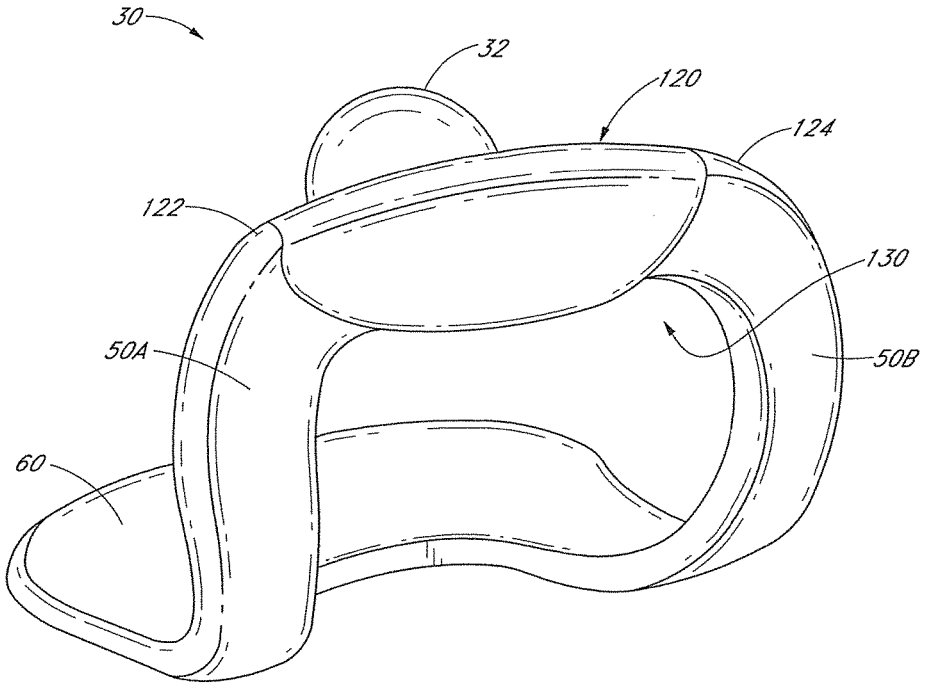
FIG. 13 is a perspective view of still another embodiment.
Figure 14:
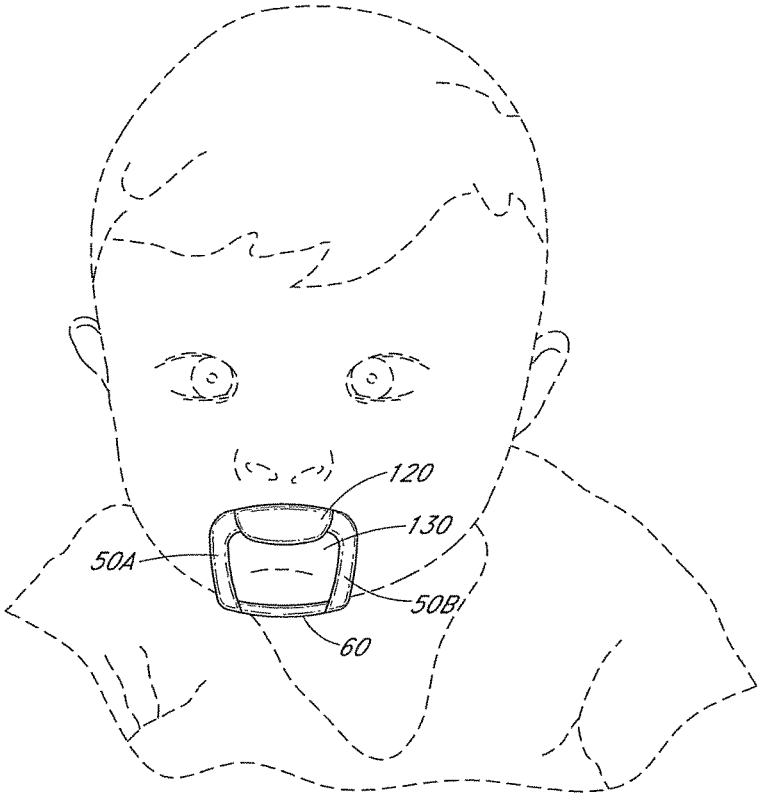
FIG. 14 shows the embodiment of FIG. 13 being used by an infant.
Figure 15:
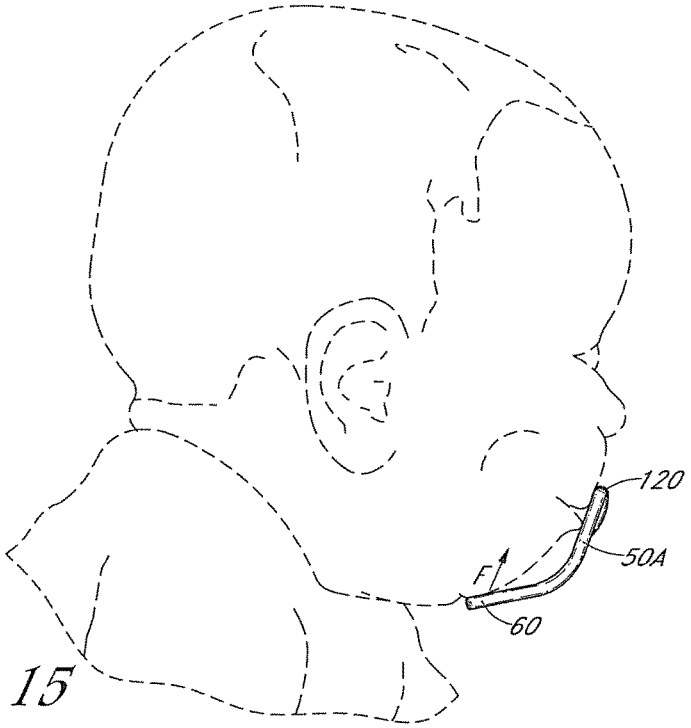
FIG. 15 is a side view of the arrangement in FIG. 14.

With reference next to FIGS. 13-15, in yet another embodiment, the nipple 32 extends proximally from a crossbar 120 having first and second ends 122, 124. The crossbar 120 is configured to extend transversely across the child's mouth and, in some instances, parts of the cheeks. First and second extensions 50A, 50B depend from the first and second ends 122, 124, respectively, and curve proximally to connect to an elongate contact pad 60. An opening 130 is defined between the crossbar 120, extensions 50A, 50B and contact pad 60 in the illustrated embodiment. Preferably, the child's chin is visible through the opening 130, and ventilation can provided by the opening 130 and otherwise around the crossbar 120, as the components wrap around the child's chin. Further, the presence of opening 130 and the relatively small size of the extensions and the like help ensure that, were the child able to swallow the pacifier, air could still pass by the pacifier, thus eliminating a choking hazard.

Notably, the crossbar 120 and extensions 50A, 50B in the illustrated embodiment together operate as a shield 40, and help prevent the nipple 32 from being drawn too far into the child's mouth. In a preferred embodiment, the diagonal measurement from the upper end of one of the extensions 50A, 50B to a bottom end of the other of the extensions 50A, 50B is sufficient to accomplish the function of the shield, and preferably is greater than 42.7 mm. Further, in this embodiment, as in some of the other embodiments, the nipple 32 extends from the crossbar 120, which is in an upper portion of the shield, and not from a center of the shield.

In a preferred embodiment the crossbar 120, extensions 50A, 50B and contact pad 60 each comprises a metal core, such as a metal sheet or ribbon, encased in malleable silicone. The metal core can, in some embodiments, be plastically deformable so that a parent or other user can modify the shape of the pacifier 30 to best fit the child's face, and the pacifier 30 will retain the modification. The metal core can also be elastically deformable so as to apply a biasing force during use while installed on the child. In additional embodiments, the metal core is configured so as to not normally he plastically deformed, but to be elastically deformed during use to apply a biasing force F directed toward the nipple 32. Other materials, such as plastic bars, sheets or ribbons, can be enclosed within one or more of the crossbar 120, extensions 50A, 50B and contact pad 60. Such other materials can provide support, stability and biasing for the pacifier 30.

The crossbar 120 can have a thickened portion that may include a coating such as a soft elastomeric coating. Each of the crossbar 120, extensions 50A, 50B, and contact pad 60 in the illustrated embodiment are generally rectangular in cross section, and have relatively flat surfaces for engaging a child's skin. In some embodiments the contact pad (or other surfaces) can employ a high-grip material such as a soft silicone and/or a roughened surface to increase frictional engagement below the child's chin.

Figure 16:
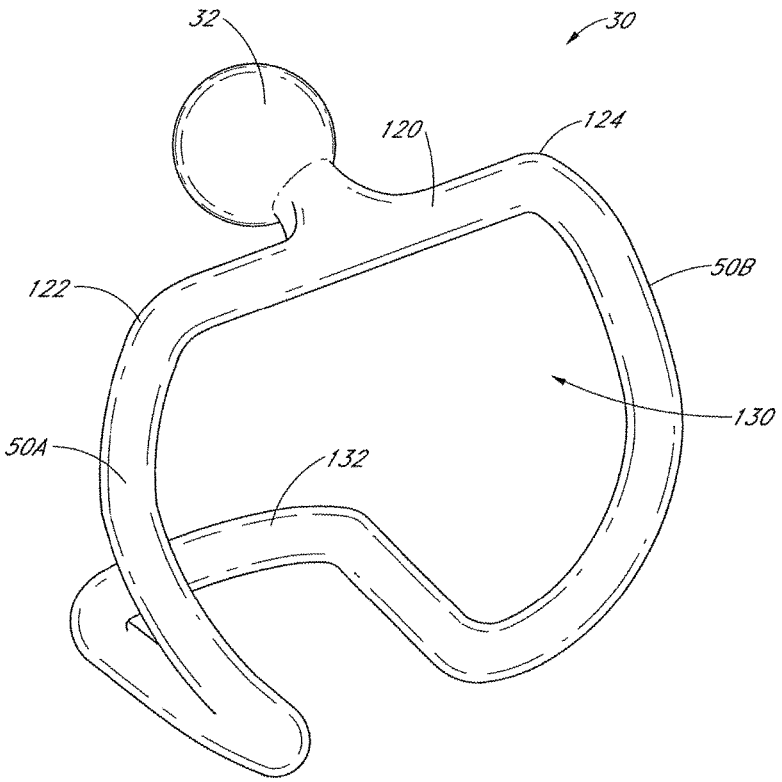
FIG. 16 is a perspective view of a still further embodiment.

With reference next to FIG. 16, another embodiment may also employ a crossbar 120, and first and second extensions 50A, 50B that extend to a contact crossbar 132. In this embodiment, each of the extensions 50A, 50B, crossbar 120 and contact crossbar 132 are generally circular or oval in cross-section rather than flat or rectangular.

Figure 17A:
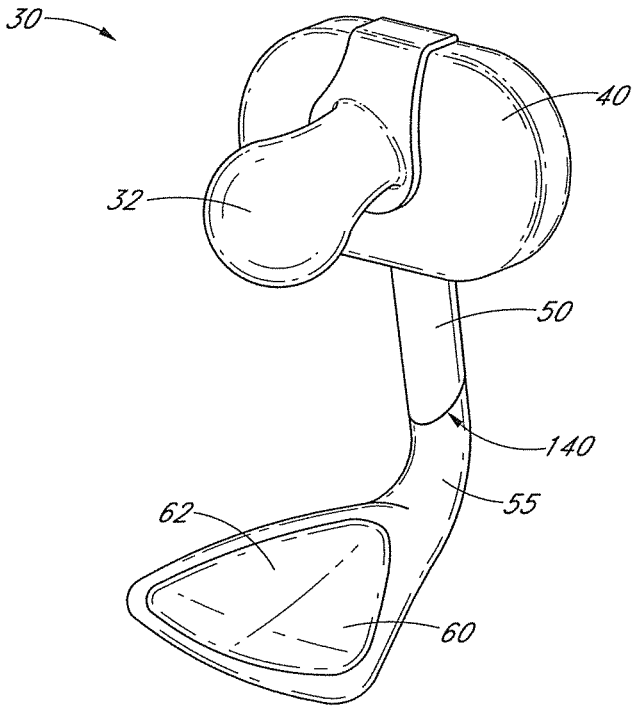
FIG. 17A is a perspective view of a yet further embodiment in a first configuration.
Figure 17B:
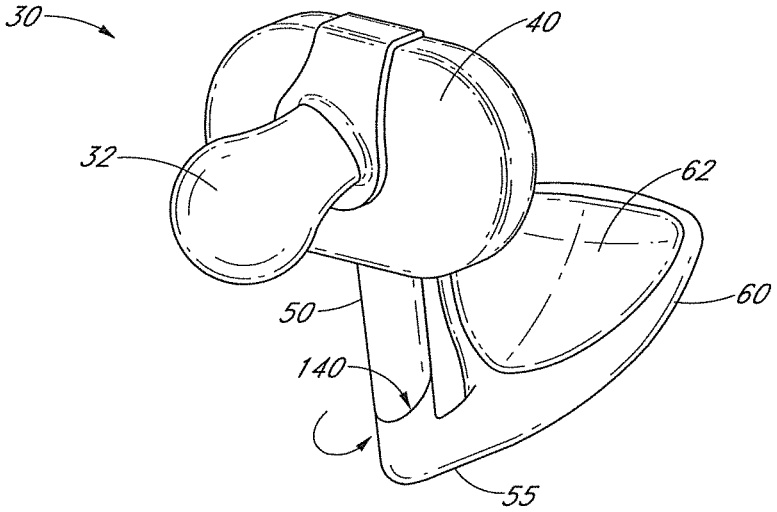
FIG. 17B shows the arrangement of FIG. 17A in a second configuration.
Figure 18A:
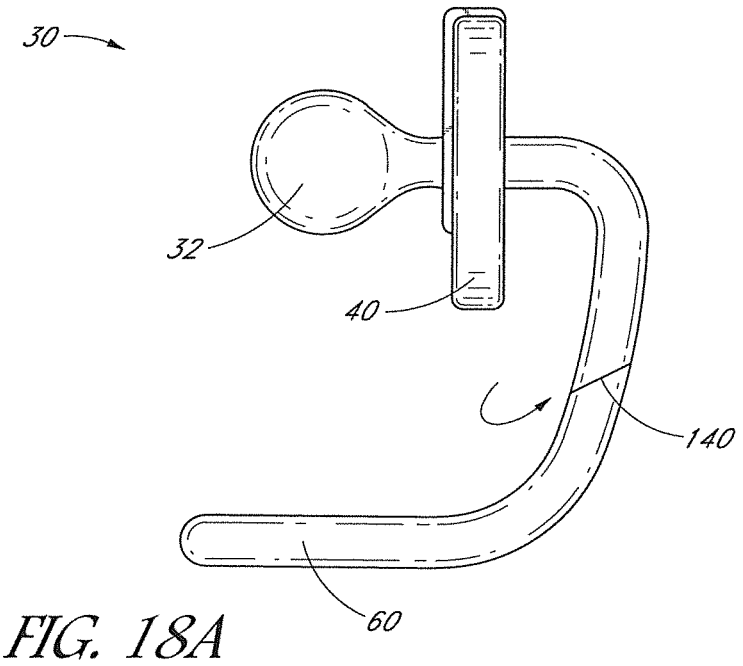
FIG. 18A is a side view of the embodiment of FIG. 17A in the first configuration.
Figure 18B:
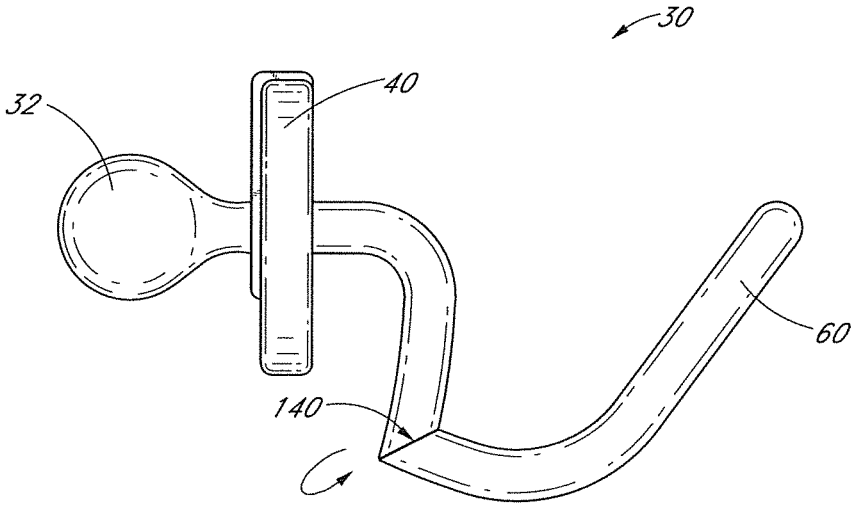
FIG. 18B shows the arrangement of FIG. 18A in the second configuration.

With reference next to FIGS. 17-18, in still another embodiment, the pacifier 30 may have a nipple 32, shield 40, extension 50, and retainer portion 55 that resemble and are configured similarly to other embodiments discussed herein. For example, as shown in FIGS. 17A and 18A, the nipple 32 is laterally spaced from the contact pad 60 so that when the nipple 32 is in a child's mouth the contact pad 60 generally engages the child's chin. However in the illustrated embodiment a rotating hinge 140 is provided in the extension 50 so that, as shown in FIGS. 17B and 18B, the retainer portion 55 can be rotated about 180° so that the contact pad 60 is no longer laterally aligned with the nipple 32, but instead spaced distally from the nipple 32 and shield 40. Thus, when the nipple 32 is in the child's mouth, the contact pad 60 no longer engages the child's chin. Instead, in the second configuration, the pacifier 30 can operate substantially as a typical conventional pacifier.

In some embodiments, any rotating hinge will do as long as it pulls the contact pad out of engagement with you wearers can in the illustrated embodiment, however, in the illustrated embodiment the hinge 140 is configured to rotate about a line that is angled and non-normal manner relative to an axis of the extension 50 at the hinge 140. As such, and as best depicted in FIGS. 17B and 18B, when in the second configuration the contact pad 60 is disposed distally of and generally aligned with the nipple 32.

Figure 19A:
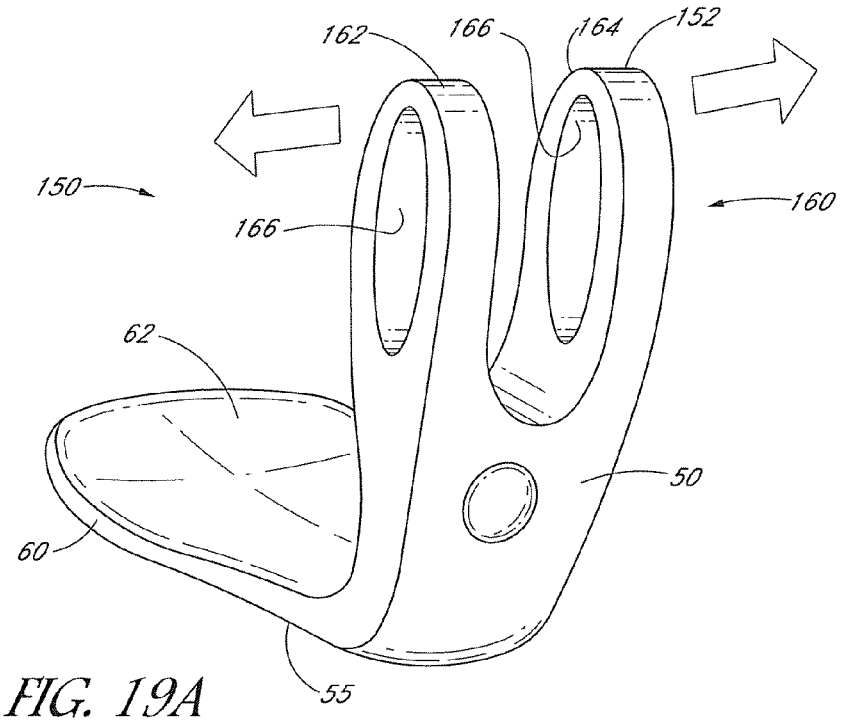
FIG. 19A is a perspective view of a pacifier retainer embodiment having features in accordance with the present disclosure.
Figure 19B:
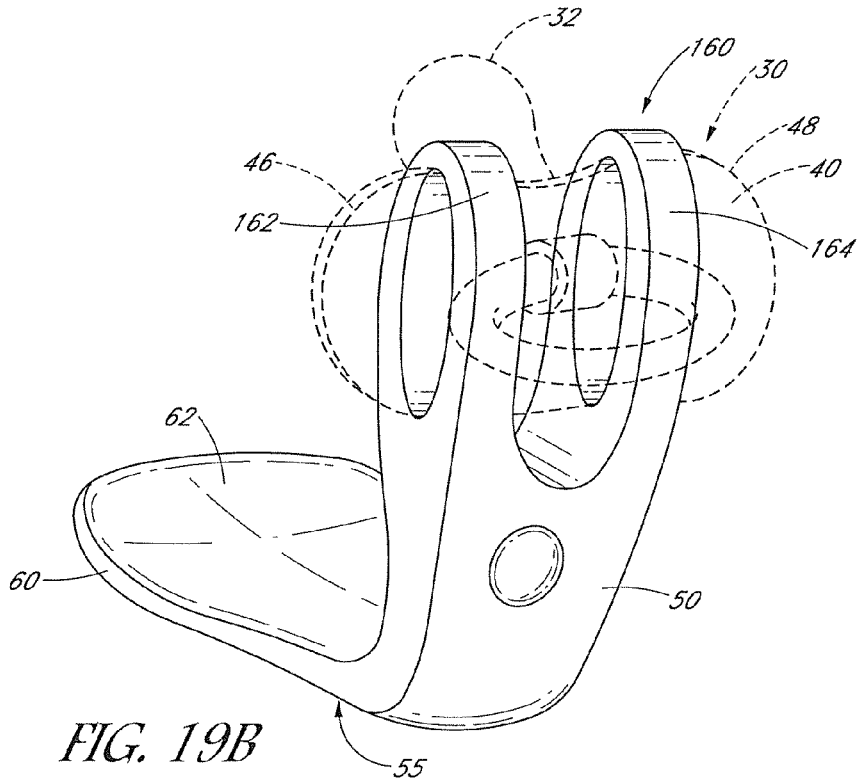
FIG. 19B shows the pacifier retainer embodiment of FIG. 19A holding a typical pacifier.

With reference next to FIGS. 19A and 19B, an embodiment of a pacifier retainer 150 is shown. The pacifier retainer 150 comprises an extension 50 that can depend, for example, generally vertically from a first end 152 and curve proximally to transition to a retainer portion 55 that extends, for example, to a generally concave contact pad 60. The first end 152 of the extension 50 comprises a connector 160 that, in the illustrated embodiment, is split into opposing first and second receivers 162, 164, each of which includes an elongated receiver aperture 166. Preferably, the receivers 162, 164 are generally elastomeric and can be elastically deformed and pulled away from each other. As best shown in FIG. 19B, preferably the shield wings 46, 48 of a conventional pacifier 30 can be fit through the receiver apertures 166 so that the pacifier 30 is held in place. Preferably the receivers 162, 164 and receiver apertures 166 are deformed elastically in order to fit the pacifier wings 46, 48 in place and so that, once in place, the receivers tightly engage the wings 46, 48 and the pacifier 30 is thus held firmly in position. In this arrangement, the nipple 32 of the pacifier 30 is aligned with and transversely spaced from the contact pad 60 so that when the nipple 32 is placed in the child's mouth, the contact pad 60 engages and applies a biasing force F below the child's chin in order to help hold the pacifier 30 in place with the nipple 32 in the child's mouth.

It is to be understood that other embodiments of a pacifier retainer can apply the inventive principles as discussed above in conjunction with other structure. For example, the connector at the first end of the extension 50 can be configured to attach to the stem 34 of a conventional pacifier 30, and a user can connect the conventional pacifier to the pacifier retainer 150 by deforming the pacifier bulb 36, fitting it through a circular connector, and sliding the connector down to the stem. In other embodiments, the connector can also, or instead, comprise a flange or secondary connector configured to fit around or otherwise engage the shield of the conventional pacifier to provide a secondary connection and to ensure a more secure fit. Still other connectors are anticipated. For example, in still other embodiments the connector can comprise a rigid or semi-rigid piece that can be releasably or permanently connected to the shield of the pacifier. Also, in some embodiments, the connector can make use of permanent or releasable adhesives.

The embodiments discussed above have disclosed structures with substantial specificity. This has provided a good context for disclosing and discussing inventive subject matter. However, it is to be understood that other embodiments may employ different specific structural shapes and interactions. Also, although components such as contact pads, gripping surfaces, extensions, retainer portions, shields, nipples, stems and the like can have different specific structural features, most of the embodiments described herein include most or all of these components. It is specifically contemplated that a component as described in connection with one of the embodiments specifically described herein can be substituted for the corresponding component in another one of the embodiments described specifically herein. For example, although the biasing insert 90 is specifically shown only in the embodiment illustrated in FIG. 9, any of the other embodiments described herein can employ such a biasing insert 90 in the catheter pad, retainer portion and/or extension. Similarly, the malleable insert 110 as depicted in FIG. 10, can be employed in any of the other embodiments, as can modifications thereof Still further, embodiments are contemplated that will make use of inserts such as depicted in FIGS. 9 and 10, but in a single embodiment and possibly configured in a different manner, including possibly overlapping one another.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, l but should be determined only by a fair reading of the claims that follow:

What is claimed is:

1. A pacifier, comprising:

a nipple portion comprising a bulb and a stem, the bulb extending proximally from the stem;

a shield, the nipple portion extending proximally from the shield, the shield extending radially outwardly about the circumference of the stem and having an outer edge comprising top, side and bottom edge portions, the entire shield outer edge being distal of the bulb;

a retainer portion spaced from the nipple portion, the retainer portion extending proximally and terminating at a contact pad; and an extension extending between the nipple portion and the retainer portion, at least part of the extension being distal of the nipple portion and attached to the shield, the extension depending below the bottom edge portion of the shield, the extension supporting the retainer portion so as to maintain the retainer portion at a position wherein the retainer portion extends proximally, generally parallel to and spaced from the stem;

wherein the retainer portion is biased toward the nipple portion; and wherein no portion of the pacifier proximal of the shield extends higher than the top edge portion of the shield when the pacifier is held so that the stem extends horizontally with the top edge portion of the shield higher than the stem.

2. A pacifier as in claim 1, wherein the contact pad of the retainer portion comprises a grip surface, the grip surface formed of a different material than the extension.

3. A pacifier as in claim 1, wherein the contact pad is concave.

4. A pacifier as in claim 1, wherein a width of the contact pad is greater than a width of the extension.

5. A pacifier as in claim 1 additionally comprising a second extension spaced from the extension, and the retainer portion is connected to both the extension and the second extension.

6. A pacifier as in claim 1, wherein the contact pad is arranged generally centrally below the bulb.

7. A pacifier as in claim 6, wherein the contact pad, when deflected, exerts a biasing force directed toward the bulb.

8. A pacifier retainer configured to be selectively attachable to and detachable from a pacifier that has a shield and a nipple portion with a bulb and a stem, the nipple portion extending proximally the shield, the shield extending radially outwardly about the circumference of the stem and having an outer edge comprising top, side and bottom edge portions, the entire shield outer edge being distal of the bulb, the pacifier retainer comprising:

an elongate extension having a connector at or adjacent a first end, the connector being configured to selectively attach to and detach from the pacifier so that the nipple portion extends proximally from the connector and the elongate extension depends below the bottom edge portion of the pacifier shield when the connector is attached to the pacifier; and a retainer portion attached to the elongate extension at a location spaced from the connector and being supported by the elongate extension so that the retainer portion is maintained at a position in which it extends proximally from the elongate extension;

wherein the elongate extension and retainer portion are configured so that the retainer portion is spaced from the nipple portion of the pacifie when the connector of the elongate extension is attached to the pacifier; and wherein the elongate extension supports the retainer portion so that the retainer portion is biased toward the nipple portion.

9. A method as in claim 8, wherein the connector is configured to selectively attach to and detach from the pacifier shield.

10. A method of soothing an infant, comprising:

Inserting a nipple portion into the infant's mouth so that a stem extends out of the infant's mouth, the stem being connected to a shield that extends radially outwardly about the circumference of the stem, and a front side of the shield ngages the infant's face; and engaging a retainer portion with a portion of the infant's face spaced from the infant's mouth so that a contact pad of the retainer portion applies a biasing force against the infant's face, the retainer portion being attached to the stem via an extension, the extension being attached to the shield;

wherein the contact pad of the retainer portion is applied under the infant's chin;

wherein a portion of the extension between the shield and the retainer portion is spaced from the infant's face; and wherein the biasing force is directed generally toward the nipple portion, and helps retain the nipple portion in the infant's mouth.

11. A method as in claim 10, additionally comprising plastically adjusting a shape of the extension prior to applying the contact pad of the retainer portion under the infant's chin.

12. A method as in claim 10, wherein the contact pad of the retainer portion is directly below the nipple portion.

13. A method as in claim 12, wherein the biasing force squeezes between the infant's mouth and chin and prevents the nipple portion from dropping from the infant's mouth when the infant's mouth is opened.

14. A method as in claim 10, additionally comprising attaching the extension to the shield before inserting the nipple portion into the infant's mouth.

15. A method as in claim 10, wherein the stem and nipple portion extend proximally from the shield, and the retainer portion is disposed proximal of the nipple portion.

16. A method as in claim 10, wherein the biasing force prevents the nipple portion from dropping from the infant's mouth when the infant's mouth is opened.

17. A method of soothing an infant, comprising:

inserting a nipple portion into the infant's mouth so that a stem extends out of the infant's mouth;

engaging a retainer portion with a portion of the infant's face spaced from the infant's mouth so that a contact pad of the retainer portion is applied under the infant's chin and directly below the nipple portion so that the contact portion applies a biasing force against the infant's face, the retainer portion being attached to the stem via an extension;

wherein the biasing force squeezes between the infant's mouth and chin and prevents the nipple portion from dropping from the infant's mouth when the infant's mouth is opened.

18. A method as in claim 17, wherein the stem is connected to a shield that extends radially outwardly about the circumference of the stem, and the extension is attached to the shield.

19. A method as in claim 18, wherein a front side of the shield engages the infant's face, and wherein a portion of the extension is spaced from the infant's face.

20. A method as in claim 19, additionally comprising plastically adjusting a shape of the extension prior to applying the contact pad of the retainer portion under the infant's chin.

* * * * *